US008059071B2

(12) United States Patent
Kim et al.

(10) Patent No.: US 8,059,071 B2
(45) Date of Patent: Nov. 15, 2011

(54) PIXEL AND ORGANIC LIGHT EMITTING DISPLAY HAVING REDUCED NUMBER OF OUTPUT LINES IN A DATA DRIVER

(75) Inventors: Yang Wan Kim, Yongin-si (KR); Michael Choi, Yongin-si (KR); Ki Myeong Eom, Yongin-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1017 days.

(21) Appl. No.: 11/655,169

(22) Filed: Jan. 19, 2007

(65) Prior Publication Data

US 2008/0036704 A1 Feb. 14, 2008

(30) Foreign Application Priority Data

Aug. 8, 2006 (KR) ..... 10-2006-0074590

(51) Int. Cl.
*G09G 3/32* (2006.01)

(52) U.S. Cl. ..... 345/82

(58) Field of Classification Search ..... 345/36, 345/39, 44–46, 74.1–83; 315/169.3; 313/463
See application file for complete search history.

(56) References Cited

U.S. PATENT DOCUMENTS 5,426,447 A 6/1995 Lee
2003/0227262 A1 12/2003 Kwon
2005/0017934 A1* 1/2005 Chung et al. ..... 345/82
2005/0093464 A1* 5/2005 Shin et al. ..... 315/169.1
2005/0110727 A1* 5/2005 Shin ..... 345/76
2005/0243031 A1* 11/2005 Fish et al. ..... 345/76

FOREIGN PATENT DOCUMENTS

CN 1577453 2/2005
(Continued)

OTHER PUBLICATIONS

Search Report issued in European Patent Application No. 07252864.9 on Nov. 5, 2007.

(Continued)

*Primary Examiner* — Chanh Nguyen
*Assistant Examiner* — Ram Mistry
(74) *Attorney, Agent, or Firm* — Christie, Parker & Hale, LLP

(57) ABSTRACT

A pixel and an organic light emitting display using the same, which reduces the number of output lines in a data driver and stably express black gradation. The pixel includes an organic light emitting diode; a storage capacitor coupled between a first power supply and an initialization power supply and being charged with a voltage corresponding to a data signal; a first transistor controlling an amount of an electric current supplied to the organic light emitting diode corresponding to the voltage charged in the storage capacitor; a second transistor coupled between a data line and a current scan line, supplying a data signal to be provided to the data line when a scan signal is supplied to the current scan line; a third transistor coupled between a gate electrode and a second electrode of the first transistor, and being turned-on when the scan signal is supplied to the current scan line; and a boosting capacitor coupled between the current scan line and the gate electrode of the first transistor, boosting a voltage of the gate electrode of the first transistor when a supply of the scan signal to the current scan line stops.

10 Claims, 9 Drawing Sheets

FOREIGN PATENT DOCUMENTS

| | | |
|---|---|---|
| CN | 1684132 | 10/2005 |
| CN | 1776796 | 5/2006 |
| EP | 1 496 495 | 12/2005 |
| EP | 1 647 967 | 4/2006 |
| EP | 1 659 562 | 5/2006 |
| JP | 2003-140612 | 5/2003 |
| JP | 2004-12897 | 1/2004 |
| JP | 2004-29791 | 1/2004 |
| JP | 2005-31630 | 2/2005 |
| JP | 2006-65286 | 3/2006 |
| JP | 2006-106676 | 4/2006 |
| JP | 2006-113548 | 4/2006 |
| JP | 2006-146158 | 6/2006 |
| JP | 2007-52422 | 3/2007 |
| KR | 2003-75946 | 9/2003 |
| KR | 10-562647 | 3/2006 |

OTHER PUBLICATIONS

Japanese Office Action dated Mar. 16, 2010, issued in corresponding Japanese Patent Application No. 2006-314453.

Office Action issued by the State Intellectual Property Office of the People's Republic of China on Mar. 13, 2009.

* cited by examiner

PIXEL AND ORGANIC LIGHT EMITTING DISPLAY HAVING REDUCED NUMBER OF OUTPUT LINES IN A DATA DRIVER

CROSS-REFERENCE TO RELATED APPLICATION

This application claims the benefit of Korean Patent Application No. 2006-74590, filed on Aug. 8, 2006, in the Korean Intellectual Property Office, the disclosure of which is incorporated herein by reference.

BACKGROUND OF THE INVENTION

1. Field of the Invention

An aspect of the present invention relates to a pixel and an organic light emitting display using the same, and more particular to a pixel and an organic light emitting display using the same, which may reduce the number of output lines in a data driver and stably express black gradation.

2. Description of the Related Art

Recently, various flat panel displays having reduced weight and volume as compared to cathode ray tubes (CRT) have been developed. Flat panel displays include liquid crystal displays (LCD), field emission displays (FED), plasma display panels (PDP), and organic light emitting displays.

Among the flat panel displays, the organic light emitting displays make use of organic light emitting diodes that emit light by re-combination of electrons and holes. The organic light emitting display has advantages of high response speed and small power consumption. A typical organic light emitting display provides an electric current, corresponding to a data signal, to an organic light emitting diode using a drive transistor formed on every pixel, so the organic light emitting diode emits light.

FIG. 1 is a view showing a conventional organic light emitting display. With reference to FIG. 1, the conventional organic light emitting display includes a pixel portion 30, a scan driver 10, a data driver 20, and a timing control unit 50. The pixel portion 30 includes a plurality of pixels 40 formed at a crossing area of scan lines S1 to Sn and data lines D1 to Dm. The scan driver 10 drives the scan lines S1 to Sn. The data driver 20 drives the data lines D1 to Dm. The timing control unit 50 controls the scan driver 10 and the data driver 20.

The scan driver 10 generates a scan signal in response to a scan drive control signal SCS from the timing control unit 50, and sequentially provides the generated scan signal to the scan lines S1 to Sn. The scan driver 10 generates a light emitting control signal in response to the scan drive control signal SCS from the timing control unit 50, and sequentially provides the generated light emitting control signal to the light emitting control lines E1 to En.

The data driver 20 receives the data drive control signal DCS from the timing control unit 50. Upon the receipt of the data drive control signal DCS, the data driver 20 generates data signals, and provides the generated data signals to the data lines D1 to Dm. Here, the data driver 20 provides the data signals of one line to the data lines D1 to Dm every 1 horizontal period.

The timing control unit 50 generates a data drive control signal DCS and a scan drive control signal SCS according to externally supplied synchronous signals. The data drive control signal DCS generated by the timing control unit 50 is provided to the data driver 20, and the scan drive control signal SCS is provided to the scan driver 10. Furthermore, the timing control unit 50 provides externally supplied data Data to the data driver 20.

The pixel portion 30 receives a first power supply ELVDD and a second power supply ELVSS from an exterior, and provides them to respective pixels 40. Upon the receipt of the first power supply ELVDD and the second power supply ELVSS, the pixels 40 control an amount of a current into the second power supply ELVSS from the first power supply ELVDD through a light emitting element corresponding to the data signal, thus generating light corresponding to the data signal. Furthermore, light emitting time of the pixels 40 is controlled by the light emitting control signal.

In the aforementioned conventional organic light emitting display, each of pixels 40 is disposed at the intersection of the scan lines S1 to Sn and the data lines D1 to Dm. The data driver 20 includes m output lines, which may supply a data signal to m data lines D1 to Dm, respectively. Namely, the data driver of the conventional organic light emitting display includes the same number of output lines as the number of the data lines D1 to Dm, thereby increasing manufacturing cost. Therefore, although the resolution and size of the pixel portion 30 increases, the data driver 20 includes more output lines, thereby increasing the manufacturing cost.

SUMMARY OF THE INVENTION

Accordingly, it is an aspect of the present invention to provide a pixel and an organic light emitting display using the same, which may reduce the number of output lines in a data driver and stably express black gradation.

The foregoing and/or other aspects of the present invention are achieved by providing a pixel including: an organic light emitting diode; a storage capacitor coupled between a first power supply and an initialization power supply and being charged with a voltage corresponding to a data signal; a first transistor to control an amount of an electric current supplied to the organic light emitting diode corresponding to the voltage charged in the storage capacitor; a second transistor coupled between a data line and a current scan line, supplying a data signal to be provided to the data line when a scan signal is supplied to the current scan line; a third transistor coupled between a gate electrode and a second electrode of the first transistor, and being turned-on when the scan signal is supplied to the current scan line; and a boosting capacitor coupled between the current scan line and the gate electrode of the first transistor, to boost a voltage of the gate electrode of the first transistor when a supply of the scan signal to the current scan line stops.

According to another aspect of the present invention, there is provided an organic light emitting display including: a data driver to supply a plurality of data signals to respective output lines during a data period of a horizontal time period; a scan driver to sequentially supply a scan signal to scan lines during a scan period of the horizontal time period which is a time period other than the data period, respectively, and supplying an emission control signal to emission control lines during at least two horizontal time periods; demultiplexers installed at the respective output lines supplying the plurality of data signals to the plurality of data lines during the data period; data capacitors installed at the respective data lines to store the data signal; and pixels to generate light of predetermined luminance corresponding to the data signal, wherein each of the pixels includes: an organic light emitting diode; a storage capacitor coupled between a first power supply and an initialization power supply and being charged with a voltage corresponding to a data signal; a first transistor to control an amount of an electric current supplied to the organic light emitting diode corresponding to the voltage charged in the storage capacitor; a second transistor coupled between a data line and a current scan line, to supply a data signal to be provided to the data line when a scan signal is supplied to the current scan line; a third transistor coupled between a gate electrode and a second electrode of the first transistor, and being turned-on when the scan signal is supplied to the current scan line; and a boosting capacitor coupled between the current scan line and the gate electrode of the first transistor, to boost a voltage of the gate electrode of the first transistor when a supply of the scan signal to the current scan line stops.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
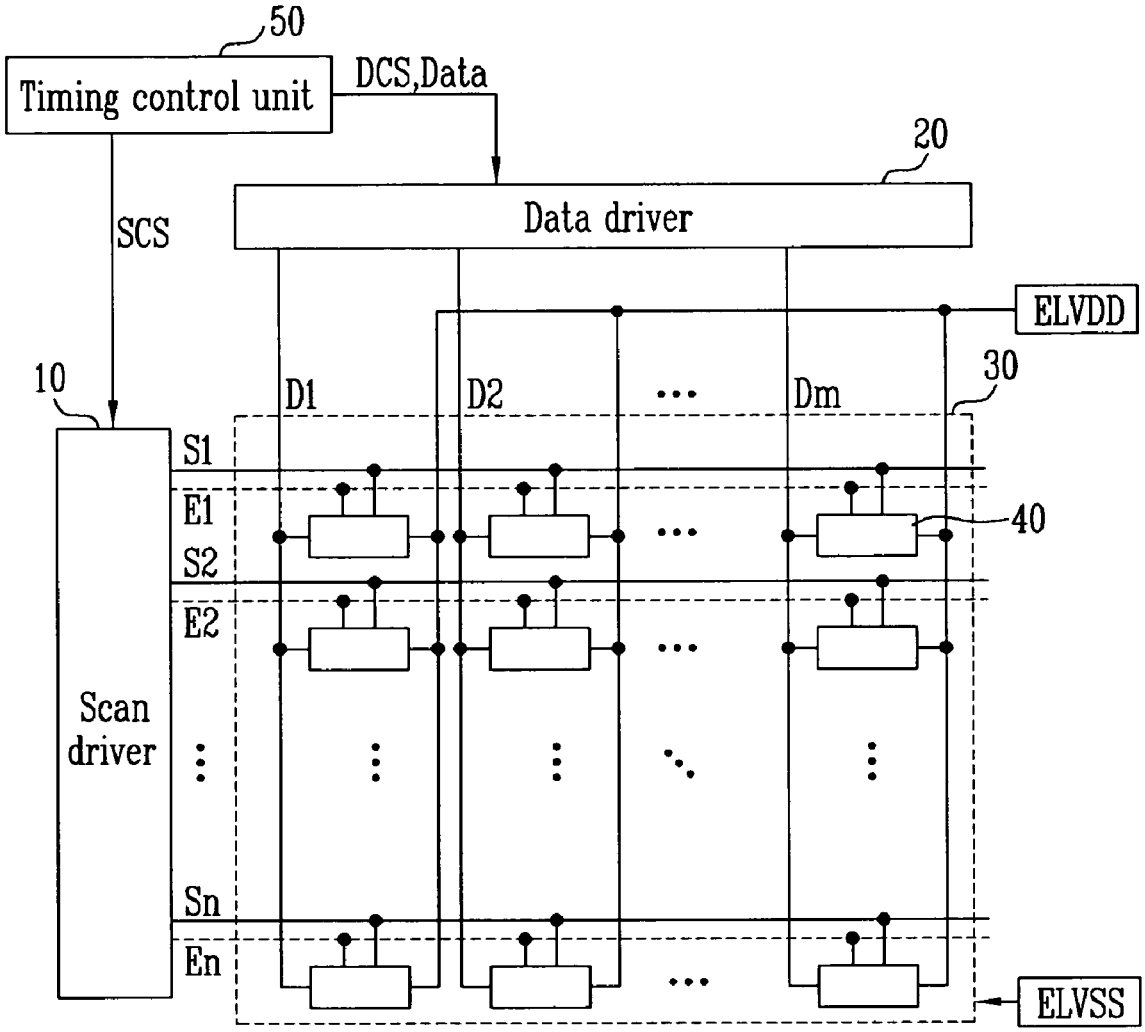
FIG. 1 (PRIOR ART)
FIG. 1 is a view showing a conventional organic light emitting display.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
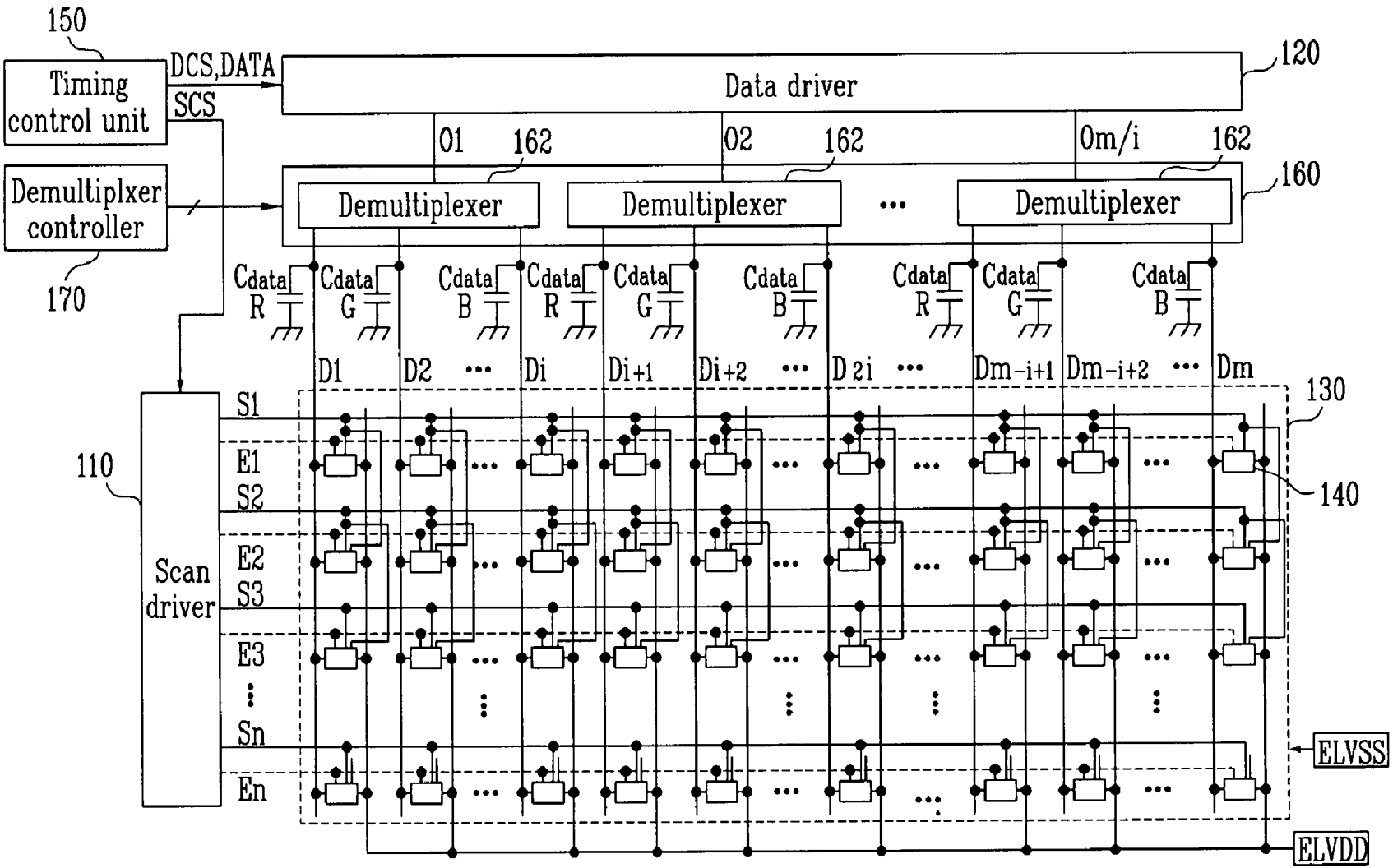
FIG. 2 is a view showing an organic light emitting display according to an embodiment of the present invention.

FIG. 2 is a view showing an organic light emitting display according to an embodiment of the present invention.

With reference to FIG. 2, the organic light emitting display according to an embodiment of the present invention includes a scan driver 110, a data driver 120, a pixel portion 130, a timing control unit 150, a demultiplexer block section 160, a demultiplexer controller 170, and data capacitors Cdata.

The pixel portion 130 includes the pixels 140, which are formed at areas divided by the scan lines S1 to Sn, the emission control lines E1 to En, and the data lines D1 to Dm. Each of the pixels 140 generates light of predetermined luminance corresponding to a data signal, which is supplied from the data line D. So as to do this, each pixel 140 is coupled to two scan lines, one data line, a power line supplying a first power supply ELVDD, and an initialization power line (not shown) supplying an initialization power supply. Each pixel 140 disposed at a final horizontal line is coupled to an n−1 th scan line Sn−1, an n-th scan line Sn, a data line D, a power line, and an initialization power line. A scan line (for example, a zero-th scan line S0) is further provided to be coupled with pixels 140, which are positioned at a first horizontal line.

Figure 4:
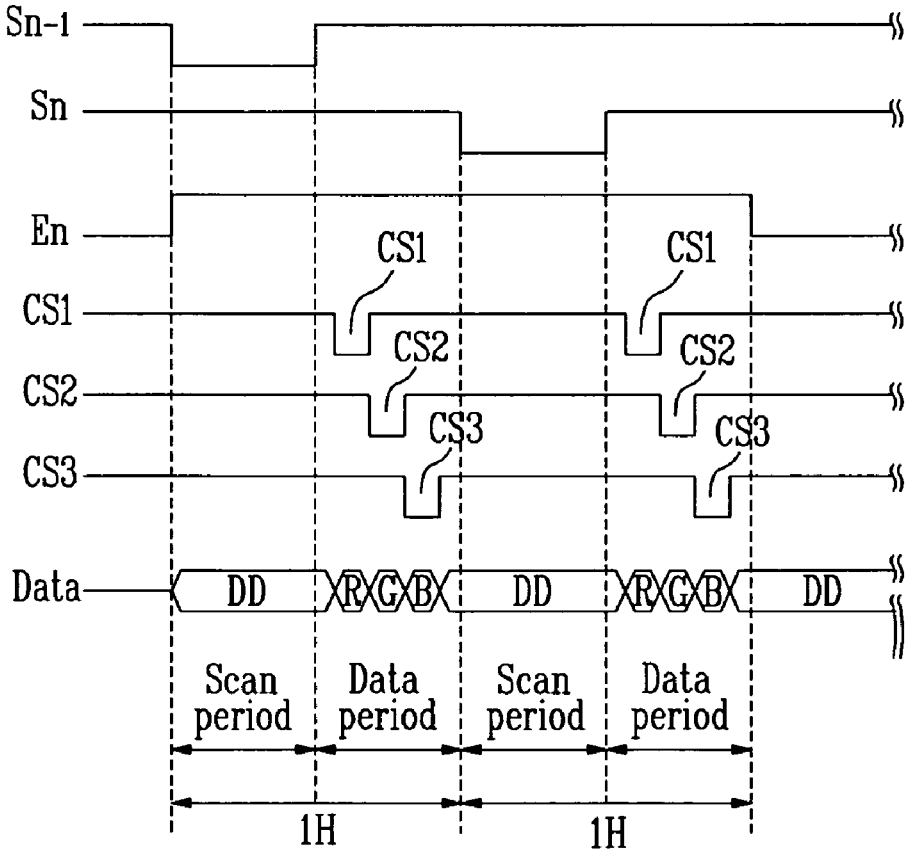
FIG. 4 is a waveform diagram showing a method of driving an organic light emitting display according to an embodiment of the present invention.

The scan driver 110 generates a scan signal in response to a scan drive control signal SCS from the timing control unit 150, and sequentially provides the generated scan signal to the scan lines S1 to Sn. Here, as shown in FIG. 4, the scan driver 110 supplies the scan signal for a part of 1 horizontal time period 1H.

In detail, in an embodiment of the present invention, one horizontal time period 1H is divided into a scan period and a data period. The scan driver 110 provides the scan signal to the scan line S during the scan period of the one horizontal time period 1H. In contrast to this, the scan driver 110 does not supply the scan signal during the data period of the one horizontal time period 1H. On the other hand, the scan driver 110 sequentially generates emission control signals to the emission control lines E1 to En, in response to a scan drive control signal SCS. Here, the scan control signal is supplied during at least two horizontal time periods.

The data driver 120 generates data signals in response to a data drive control signal DCS from the timing control unit 150, and supplies the data signals to output lines O1 to Om/i. Here, as shown in FIG. 2, the data driver 120 sequentially provides at least i ('i' is a natural number equal to or greater 2) data signals to the output lines O1 to Om/i, respectively.

In detail, the data driver 120 sequentially provides i data signals R, G, B to be supplied to a real pixel, during the data period of the one horizontal time period 1H. Here, the data signals R, G, B to be supplied to a real pixel are provided during only the data period, supply times of the data signals R, G, B and the scan signal do not overlap with each other. Further, the data driver 120 supplies a dummy data DD during the scan period of the one horizontal time period 1H, which is not rendered to luminance. Therefore, because the dummy data DD is not rendered to the luminance, it can not be supplied.

The timing control unit 150 generates a data drive control signal DCS and a scan drive control signal SCS according to externally supplied synchronous signals. The data drive control signal DCS generated by the timing control unit 150 is provided to the data driving circuit 120, and the scan drive control signal SCS is provided to the scan driving circuit 110. Furthermore, the timing control unit 150 provides externally supplied data Data to the data driving circuit 120.

The demultiplexer block section 160 includes m/i demultiplexers 162. In other words, the demultiplexer block section 160 includes the same number of demultiplexers 162 as the number of the output lines O1 to Om/i. Each of the demultiplexers 162 is connected to one of the output lines O1 to Om/i. During the data period, the demultiplexers 162 supply i data signals to the output line O through i data lines D.

When a data signal is supplied to one output line O through i data lines D, the number of the output lines O included in the data driver 120 is significantly reduced. For example, assuming that 'i' is three, the number of the output lines O included in the data driver 120 is reduced to ⅓ of that of a prior art, and accordingly the number of data driving circuits in the data driver 120 is also reduced. That is, an aspect of the present invention has the advantage of supplying a data signal to i data lines D using the demultiplexers 162, instead of using the output line O.

The demultiplexer controller 170 supplies i control signals to the demultiplexer 162 during the data period of one horizontal time period 1H so that i data signals to be supplied to the output line O are divided and supplied into i data lines D. Here, the demultiplexer controller 170 sequentially provides the i controls signals not to be overlapped with each other during the data period as shown in FIG. 4. On the other hand, FIG. 2 shows the demultiplexer controller 170, which is installed outside of the timing control unit 150. However, an aspect of the present invention is not limited thereto. For example, the demultiplexer controller 170 may be installed inside the timing control unit 150.

The data capacitors Cdata are installed at every data line D, respectively. The data capacitors Cdata temporarily store the data signal to be supplied to the data line D1, and provide the stored data signal to the pixel 140. Here, the data capacitor Cdata is used as a parasitic capacitor, which is equivalently formed at the data line D. In practice, the parasitic capacitor equivalently formed at the data line D has a greater capacity than that of a storage capacitor, and may stably store the data signal.

Figure 3:
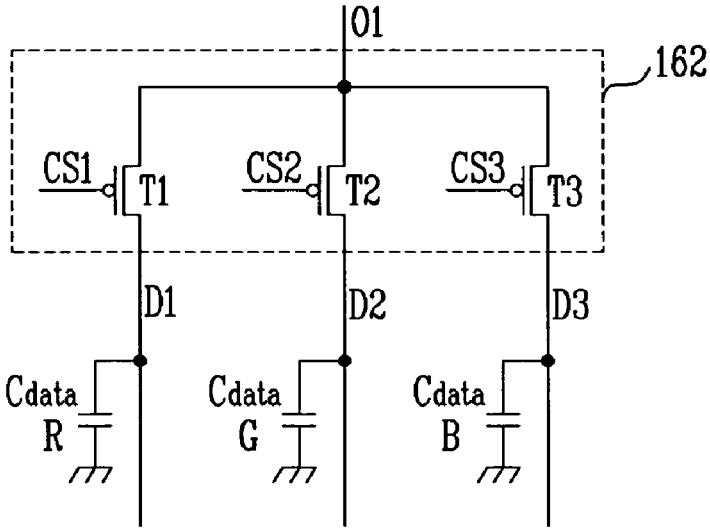
FIG. 3 is a view showing a demultiplexer shown in FIG. 2.

FIG. 3 is a view showing a demultiplexer illustrated in FIG. 2. For convenience of the description, it is assumed that "i" is 3. Further, it is assumed that the demultiplexer shown in FIG. 3 is a demultiplexer, coupled with the first data line D1.

FIG. 3 shows a demultiplexer 162 connected to a first output line O1, in which 'i' is assumed to be 3.

With reference to FIG. 3, each demultiplexer 162 includes a first switching element T1, a second switching element T2, and a third switching element T3.

The first switching element T1 is coupled between the first output line O1 and a first data line D1. When a first control signal CS1 from the demultiplexer controller 170 is supplied to the first switching element T1, it is turned-on to provide the data signal supplied to the first output line O1 to the first data line D1. When the first control signal CS1 is supplied to the first switching element T1, the data signal provided to the first data line D1 is temporarily stored in a first data capacitor CdataR.

The second switching element T2 is coupled between the first output line O1 and a second data line D2. When a second control signal CS2 from the demultiplexer controller 170 is supplied to the second switching element T2, it is turned-on to provide the data signal supplied to the first output line O1 to the second data line D2. When the second control signal CS2 is supplied to the second switching element T2, the data signal provided to the second data line D2 is temporarily stored in a second data capacitor CdataG.

The third switching element T3 is coupled between the first output line O1 and a third data line D3. When a third control signal CS3 from the demultiplexer controller 170 is supplied to the third switching element T3, it is turned-on to provide the data signal supplied to the first output line O1 to the third data line D3. When the third control signal CS3 is supplied to the third switching element T3, the data signal provided to the third data line D3 is temporarily stored in a third data capacitor CdataB.

Figure 5:
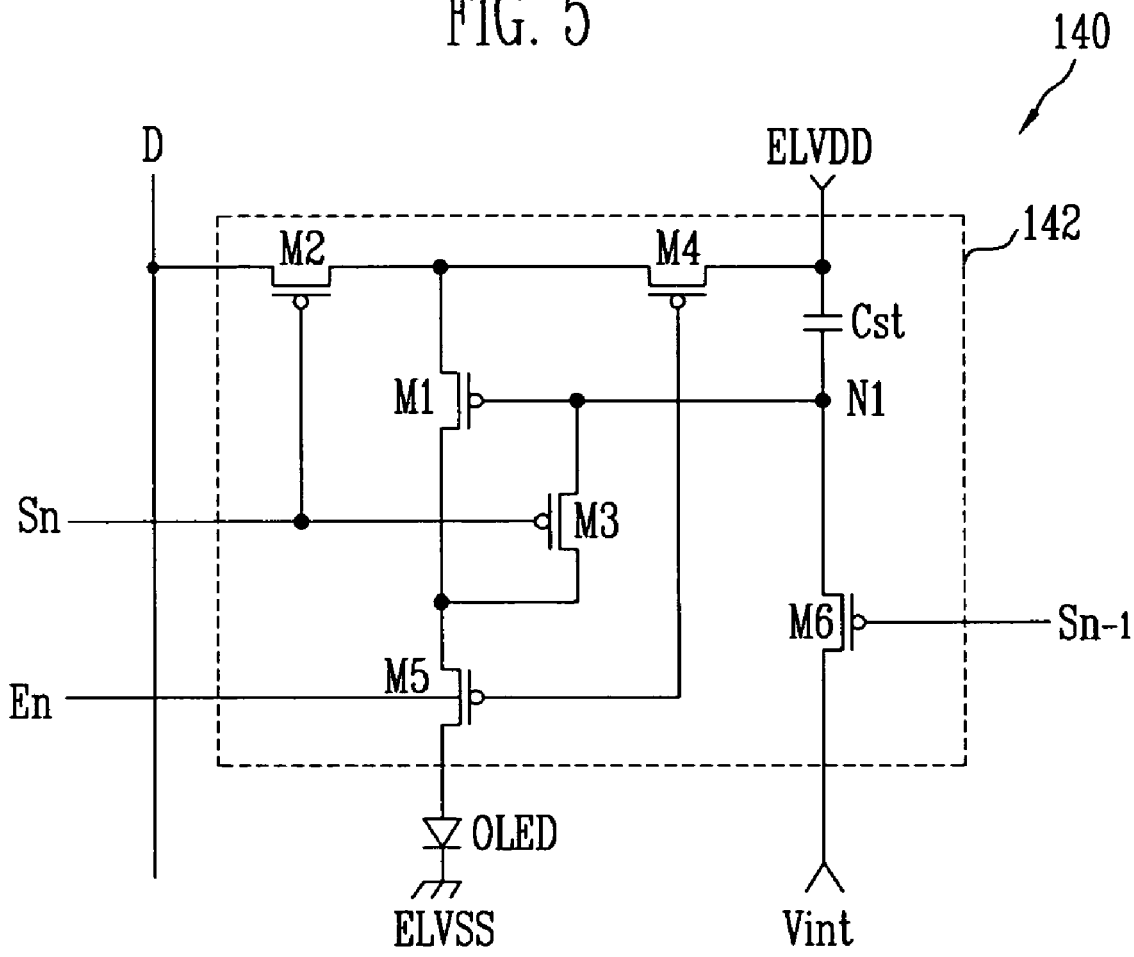
FIG. 5 is a circuitry diagram showing a pixel according to an embodiment of the present invention.

With reference to FIG. 5, each of the pixels 140 according to an embodiment of the present invention includes a pixel circuit 142 coupled with an organic light emitting diode OLED). The pixel circuit 142 is coupled with a data line D, a scan line Sn, and a light emitting control line En and controls an organic light emitting diode OLED.

An anode electrode of the organic light emitting diode OLED is coupled to the pixel circuit 142, and a cathode electrode thereof is coupled to a second power supply ELVSS. The second power supply ELVSS has a voltage lower than that of the first power supply ELVDD. The organic light emitting diode OLED generates one of red, green, and blue light corresponding to a current supplied from the pixel circuit 142.

The pixel circuit 142 includes a storage capacitor Cst, a first transistor M1, a second transistor M2, a third transistor M3, a fourth transistor M4, a fifth transistor M5, and a sixth transistor M6. The storage capacitor C and the sixth transistor M6 are coupled between the first power supply ELVDD and an initialization power supply Vint. The fourth transistor M4, the first transistor M1, and the fifth transistor M5 are coupled between the first power supply ELVDD and the light emitting element OLED. The third transistor M3 is coupled between a gate electrode and a second electrode of the first transistor M1. The second transistor M2 is coupled between the data line D and a first electrode of the first transistor M1.

Here, the first electrode is set as one of a drain electrode and a source electrode, and the second electrode is set as another electrode. For example, the first electrode is set as the source electrode, the second electrode is set as the drain electrode. Although it is shown that the first to sixth transistors M1 to M6 are formed of a P type MOSFET, an aspect of the present invention is not limited thereto. However, the first to sixth transistors M1 to M6 are formed of an N type MOSFET, a pole of a drive waveform is inverted as known to a person skilled in the art.

A first electrode of the first transistor M1 is coupled with the first power supply ELVDD through the fourth transistor M4, and a second electrode thereof is coupled with the organic light emitting diode through the fifth transistor M5. Moreover, a gate electrode of the first transistor M1 is coupled to a first node N1. The first transistor M1 provides a current corresponding to a voltage charged in the storage capacitor C, namely, a voltage applied to the first node N1, to the light emitting element OLED.

A first electrode of the third transistor M3 is coupled with the second electrode of the first transistor M1, and a second electrode thereof is coupled to a gate electrode of the first transistor M1. Further, a gate electrode of the third transistor M3 is coupled with the n-th scan line Sn. When the scan signal is supplied to the n-th scan line Sn, the third transistor M3 is turned-on, thereby causing the first transistor M1 to be diode-connected. That is, when the third transistor M3 is turned-on, the first transistor M1 is diode-connected.

A first electrode of the second transistor M2 is coupled to the data line D, and a second electrode thereof is coupled to the first node N1. Moreover, a gate electrode of the second transistor M2 is coupled to the n-th scan line Sn. When the scan line is provided to the n-th scan line Sn, the second transistor M2 is turned-on, thereby allowing the data signal on the data line D to be supplied to the first electrode of the first transistor M1.

A first electrode of the fourth transistor M4 is coupled with the first power supply ELVDD, a second electrode thereof is coupled with the first electrode of the first transistor M1. Furthermore, a gate electrode of the fourth transistor M4 is coupled with the light emitting control line En. When an emission control signal is not supplied (that is, when the emission control signal of a low level is supplied), the fourth transistor M4 is turned-on to electrically connect the first transistor M1 to the first power supply ELVDD.

A first electrode of the fifth transistor M5 is coupled with the first transistor M1, and a second electrode thereof is coupled to the organic light emitting diode OLED. In addition, a gate electrode of the fifth transistor M5 is coupled with the light emitting control line En. When the emission control signal is not provided (namely, when the emission control signal of a low level is supplied), the fifth transistor M5 is turned-on, thus electrically connecting the first transistor M1 to the light emitting element OLED.

A first electrode of the sixth transistor M6 is coupled with the storage capacitor Cst and a gate electrode of the first transistor M1 (namely, first node N1), and a second electrode thereof is coupled to the initialization power supply Vint. Further, a gate electrode of the sixth transistor M6 is coupled with an n−1 scan line Sn−1. When the scan signal is supplied to the n−1 th scan line Sn−1, the sixth transistor M6 is turned-on, thereby initializing the first node N1. So as to do this, a voltage of the initialization power supply Vint is set to be less than a voltage of the data signal.

Figure 6:
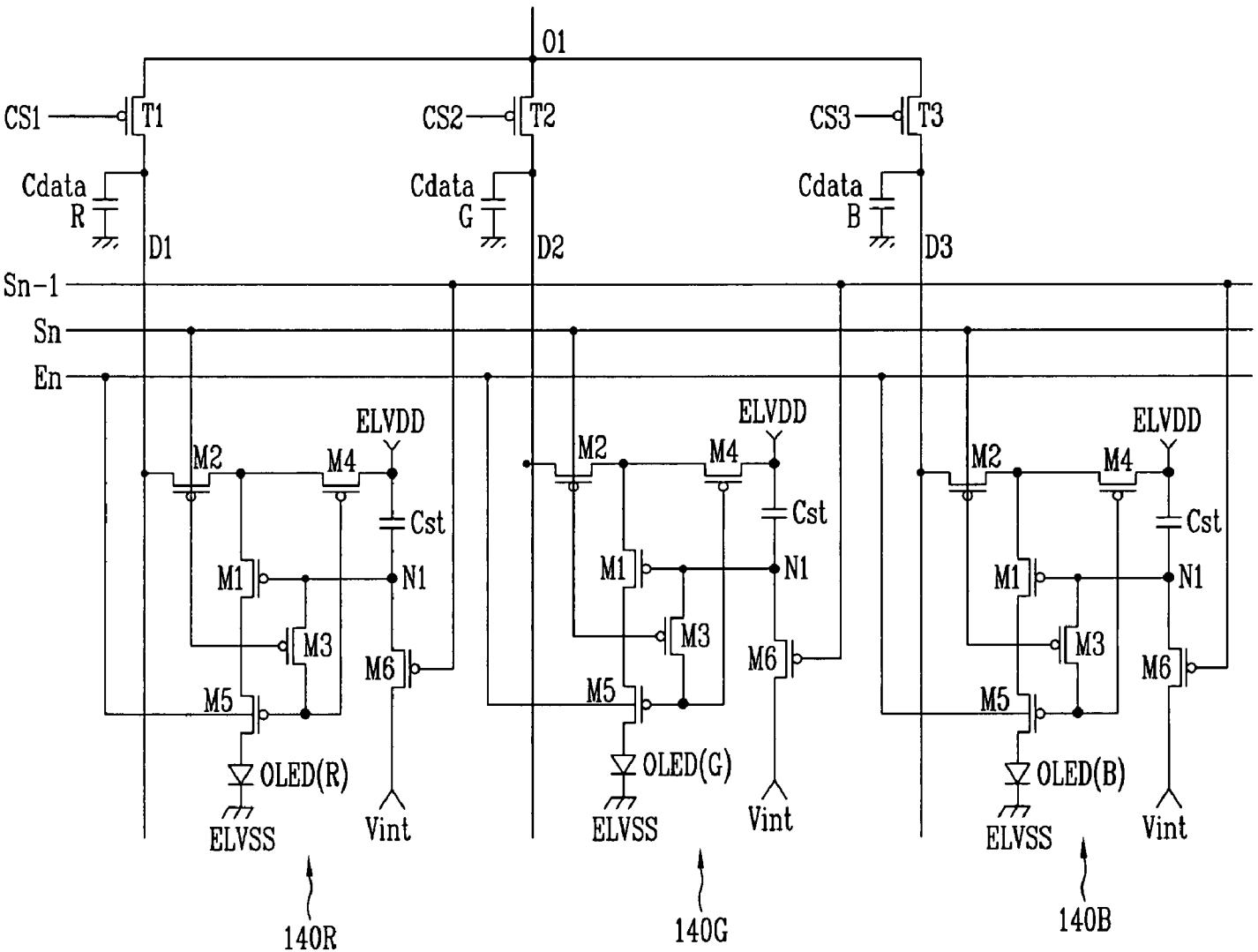
FIG. 6 is a view showing a connection of the pixel shown in FIG. 5 and the demultiplexer.

FIG. 6 is a view showing a connection of the pixel shown in FIG. 5 and the demultiplexer 162.

An operation will be explained with reference to FIG. 4 and FIG. 6. During the scan period of one horizontal time period 1H, a scan signal is supplied to an n−1 th scan line Sn−1. When the scan signal is supplied to an n−1 th scan line Sn−1, sixth transistors M6 included in pixels 140R, 140G, and 140B are turned-on. When the sixth transistors M6 are turned-on, the storage capacitor Cst and a gate electrode of the first transistor M1 is electrically connected to the initialization power supply Vint. This causes the storage capacitor Cst and the gate electrode of the first transistor M1 to be initialized with a voltage of the initialization power supply Vint.

Next, the first switching element T1, the second switching element T2, and the third switching element T3 are sequentially turned-on by first to third control signals CS1 to CS3, which are sequentially supplied thereto during a data period. When the first switching element T1 is turned-on, a first data capacitor CdataR formed at the first data line D1 is charged with a voltage corresponding to the data signal. When the second switching element T2 is turned-on, a second data capacitor CdataG formed at the second data line D2 is charged with a voltage corresponding to the data signal. When the third switching element T3 is turned-on, a third data capacitor CdataB formed at the third data line D3 is charged with a voltage corresponding to the data signal. At this time, the second transistors M2 in the pixels 140R, 140G, and 140B are turned-off, and the data signal is not supplied to the pixels 140R, 140G, and 140B.

Then, during a scan period after the data period, the scan signal is provided to an n-th scan line Sn. When the scan signal is provided to an n-th scan line Sn, the second transistor M2 and the third transistor M3 included in each of the pixels 140R, 140G, and 140B are all turned-on. When the second transistor M2 and the third transistor M3 are turned-on, a voltage corresponding to the data signal stored in the first to third capacitors CdataR to CdataB are supplied to the pixels 140R, 140G, and 140B.

At this time, because a voltage of a gate electrode of the first transistor M1 in each of the pixels 140R, 140G, and 140B is initialized with the initialization power supply Vint (namely, set to be less than a voltage of the data signal), the first transistor M1 is turned-on. When the first transistor M1 is turned-on, the data signal is supplied to the first node N1 through the first transistor M1 and the third transistor M3. At this time, a storage capacitor Cst included in each of the pixels 140R, 140G, and 140B is charged with a voltage corresponding to the data signal.

Besides the voltage corresponding to the data signal, the storage capacitor Cst is charged with a voltage corresponding to a threshold voltage of the first transistor M1. Thereafter, when the emission control signal is not supplied to the emission control line En (namely, an emission control signal of a low level is supplied), the fourth and fifth transistors M4 and M5 are turned-on, so that an electric current corresponding to the voltage charged in the storage capacitor Cst is supplied to organic light emitting diodes OLED(R), OLED(G), and OLED(B), thereby causing them to generate red, green, and blue light of predetermined luminance.

Accordingly, an aspect of the present invention has an advantage in that it can supply the data signal to i data lines D using the demultiplexer 162, rather than using the output lines O, thus reducing the number of output lines O.

However, the pixel 140 according to an embodiment of the present invention does not express black gradation in its fullest extent. This is because the voltages charged in the data capacitor Cdata during the data period are supplied to the storage capacitor Cst included in each pixel 140 during the scan period. In this case, due to a charge sharing between the data capacitor Cdata and the storage capacitor Cst, the storage capacitor Cst is charged with a lower voltage than a desired voltage.

Accordingly, when a data signal corresponding to the black gradation is supplied, the storage capacitor Cst is charged with a lower voltage than an applied voltage (namely, a voltage charged in the data capacitor Cdata). This limits the expression of black gradation.

Therefore, according to another aspect of the present invention, there is provided a method of applying a voltage of a data signal corresponding to the black gradation higher than that of the conventional data signal. However, in a currently used data driving circuit, it is impossible to apply voltage of a data signal corresponding to the black gradation higher. Further, a method of expressing the black gradation by reducing a voltage of a first power supply ELVDD may be expected. However, when the voltage of the first power supply ELVDD is reduced, a voltage of a second power supply ELVSS is also reduced, thereby significantly deteriorating efficiency of a DC/DC converter.

Figure 7:
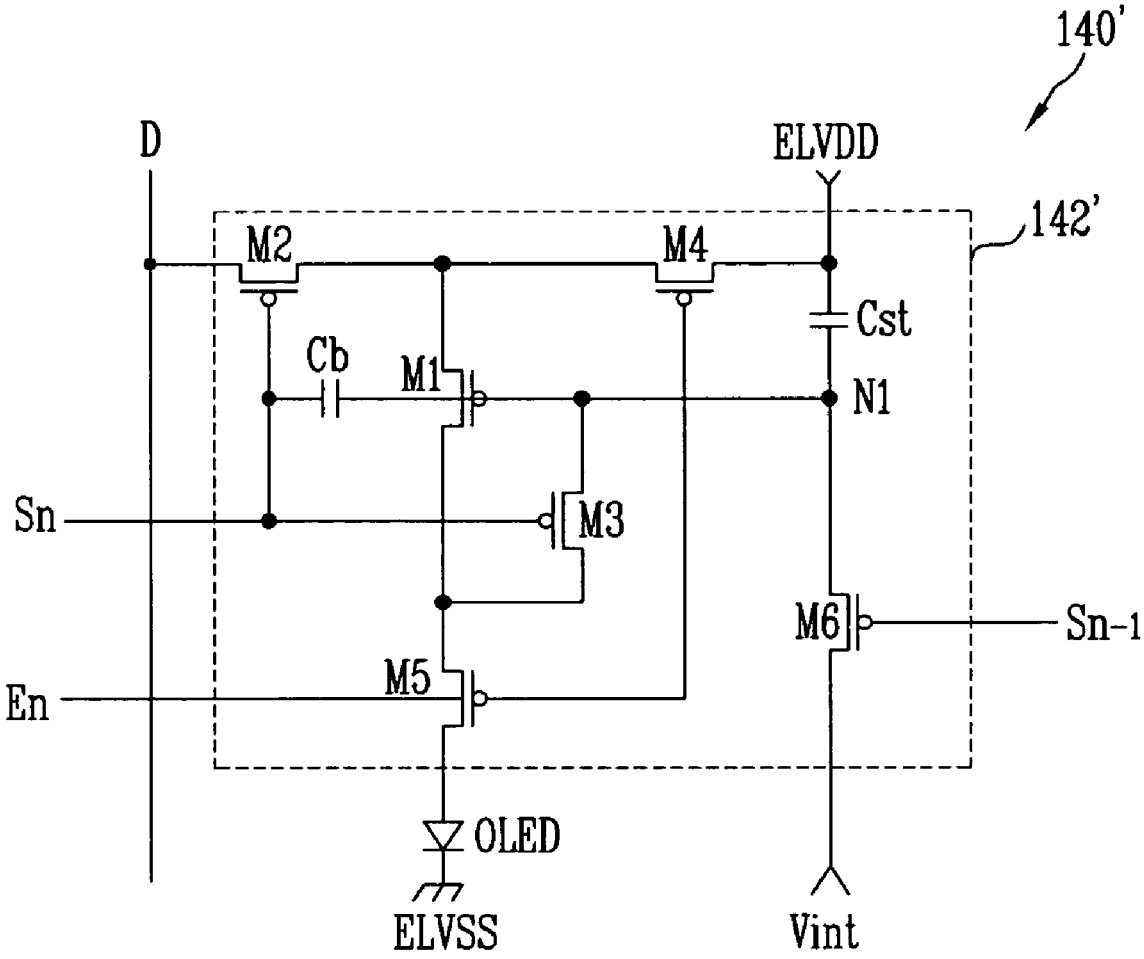
FIG. 7 is a circuitry diagram showing a pixel according to another embodiment of the present invention.

Accordingly, in order to solve the aforementioned problems, a pixel shown in FIG. 7 is suggested in another embodiment of the present invention.

FIG. 7 is a circuitry diagram showing a pixel according to another embodiment of the present invention. The same elements or components in FIG. 5 will not be described again.

Referring to FIG. 7, a pixel 140' according to another embodiment of the present invention includes a boosting capacitor Cb, which is disposed between a first node N1 and an n-th scan line Sn.

The boosting capacitor Cb increases a voltage of the first node N1 when a scan signal supplied to the n-th scan line Sn is turned-off. When the voltage of the first node N1 is increased, the pixel 140' may exactly express black gradation (including other gradations).

Figure 8:
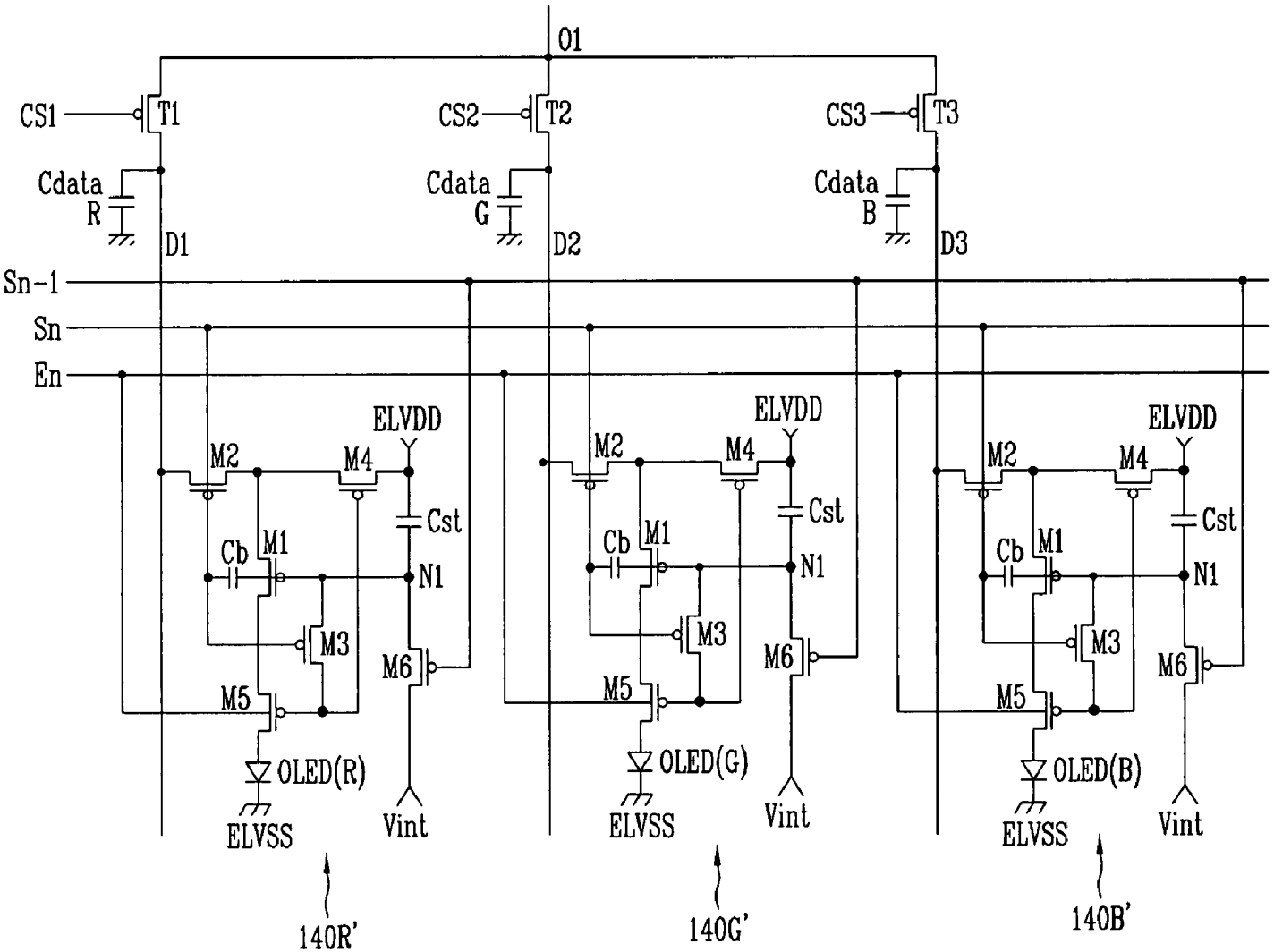
FIG. 8 is a view showing a connection of the pixel shown in FIG. 7 and the demultiplexer.

FIG. 8 is a view showing a connection of the pixel shown in FIG. 7 and the demultiplexer 162.

With reference to FIG. 4 and FIG. 8, in the operation, a scan signal is supplied to an n−b 1th scan line Sn−1 during a scan period of one horizontal time period 1H. When the scan signal is supplied to an n−1th scan line Sn−1, a sixth transistor M6 included in each of pixels 140R', 140G', and 140B' is turned-on. When the sixth transistor M6 is turned-on, a storage capacitor Cst and a gate electrode of the first transistor M1 are electrically connected to an initialization power supply Vint. Accordingly, the storage capacitor Cst and the gate electrode of the first transistor M1 are initialized with a voltage of the initialization power supply Vint.

Next, the first switching element T1, the second switching element T2, and the third switching element T3 are sequentially turned-on by first to third control signals CS1 to CS3 sequentially supplied during the data period. When the first switching element T1 is turned-on, a first data capacitor CdataR formed at the first data line D1 is charged with a voltage corresponding to the data signal. When the second switching element T2 is turned-on, a second data capacitor CdataG formed at the second data line D2 is charged with a voltage corresponding to the data signal. When the third switching element T3 is turned-on, a third data capacitor CdataB formed at the third data line D3 is charged with a voltage corresponding to the data signal. At this time, the second transistors M2 in the pixels 140R', 140G', and 140B' are turned-off, the data signal is not supplied to the pixels 140R', 140G', and 140B'.

Then, during a scan period after the data period, the scan signal is provided to an n-th scan line Sn. When the scan signal is provided to an n-th scan line Sn, the second transistor M2 and the third transistor M3 included in each of the pixels 140R', 140G', and 140B' are all turned-on. When the second transistor M2 and the third transistor M3 are turned-on, a voltage corresponding to the data signal stored in the first to third capacitors CdataR to CdataB are supplied to the pixels 140R', 140G', and 140B'.

At this time, because a voltage of a gate electrode of the first transistor M1 in each of the pixels 140R', 140G', and 140B' is initialized with the initialization power supply Vint (namely, set to be less than a voltage of the data signal), the first transistor M1 is turned-on. When the first transistor M1 is turned-on, the data signal is supplied to the first node N1 through the first transistor M1 and the third transistor M3. At this time, a storage capacitor Cst included in each of the pixels 140R', 140G', and 140B' is charged with a voltage corresponding to the data signal. Here, besides the voltage corresponding to the data signal, the storage capacitor Cst is charged with a voltage corresponding to a threshold voltage of the first transistor M1.

On the other hand, due to a charge sharing between the data capacitor Cdata and the storage capacitor Cst, a lower voltage than a desired voltage is supplied to the first node N1 of each of the pixels 140R', 140G', and 140B'. Accordingly, the storage capacitor Cst is not charged with the desired voltage.

Figure 9:
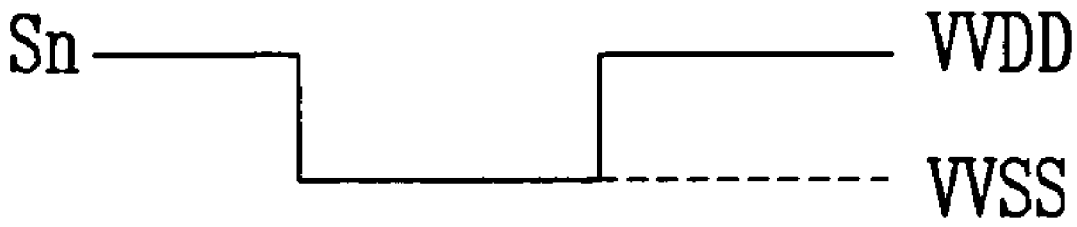
FIG. 9 is a schematic view showing a voltage of a scan line.

Then, a supply of the scan signal to the n-th scan line stops. In other words, as shown in FIG. 9, a voltage of the n-th scan line Sn is increased from a voltage of a fourth power supply WSS to a voltage of a third power supply VVDD. FIG. 9 is a schematic view showing a voltage of a scan line. Here, a voltage of the fourth power supply WSS is voltage supplied at a supply of the scan signal, and is set as a voltage to turn-on the second transistor M2 and the third transistor M3. In contrast to this, a voltage of the third power supply WDD is voltage supplied when a supply of the scan signal stops, and is set as a voltage to turn-off the second transistor M2 and the third transistor M3.

When a supply of the scan signal to the n-th scan line stops, the first node N1 is set in a floating state. Accordingly, the supply of the scan signal to the n-th scan line stops, a voltage of the first node N1 is increased by the boosting capacitor Cb. Here, the increased voltage of the first node N1 is expressed by a following equation 1.

$$\text{Increased voltage of } N1 = Cb/(Cb+Cst)\times(VVDD-VVSS) \quad (1)$$

Referring to the equation 1, the increased voltage of the first node N1 is determined by an increased value (WDD-WSS) and capacitances of the boosting capacitor Cb and the storage capacitor Cst. Accordingly, an aspect of the present invention adjusts the capacitances of the boosting capacitor Cb and the storage capacitor Cst according to a voltage lost due to a charge sharing between the data capacitor Cdata and the storage capacitor Cst in order to increase the voltage of the first node N1. Accordingly, the storage capacitor Cst can be charged with the desired voltage. This causes a desired gradation to be expressed.

On the other hand, so as to increase a voltage of the first node N1 by a desired value, a capacitance of the storage capacitor Cst is set to be greater than that of the boosting capacitor Cb. In other words, a voltage difference between the third power supply VVDD and the fourth power supply VVSS is set to be a greater voltage than 10 V. When the capacitance of the boosting capacitor Cb is set to be greater than that of the storage capacitor Cst, the voltage of the first node N is increased to a voltage higher than the desired voltage. In order to prevent this from happening, in an aspect of the present invention, the capacitance of the boosting capacitor Cb is set to be less than that of the storage capacitor Cst.

After a voltage of the first node N1 was increased because a supply of the scan signal to the n-th scan line stops, a supply of an emission control signal to an n-th emission control line En stops. Accordingly, the fourth transistor M4 and the fifth transistor M5 are turned-on to supply an electric current corresponding to the voltage charged in the storage capacitor Cst to the organic light emitting diode OLED.

Figure 10:
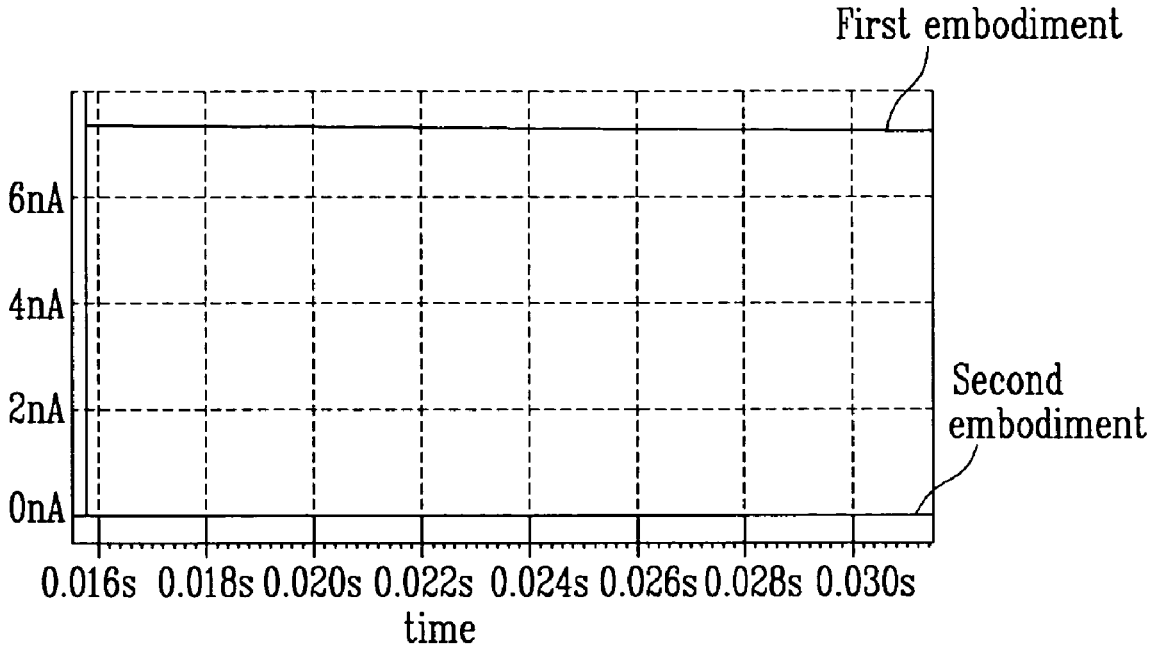
FIG. 10 is a graph view showing an electric current flowing through the pixels shown in FIG. 5 and FIG. 7 when a black gradation is expressed in the pixels.

FIG. 10 is a graph view showing an electric current supplied to an organic light emitting diode OLED when a data signal corresponding to a black gradation is supplied to pixels of the first and second embodiments of the present invention.

In FIG. 10, 5V is set to a first power supply and −6V is set to a second power supply ELVSS. Further, the storage capacitor Cst is set to have a capacitance 10 times greater than that of the boosting capacitor Cb.

With reference to FIG. 10, when a data signal corresponding to a black gradation is supplied to a pixel according to another embodiment of the present invention shown in FIG. 7, an electric current of approximately 0.02 nA is provided to the organic light emitting diode OLED. Accordingly, the organic light emitting diode OLED does not emit light to express an exact black gradation.

As is evident from the above explanation, in accordance with a pixel and an organic light emitting display using the same according to an aspect of the present invention, a data signal to be supplied to one output line can be provided to a plurality of data lines, thereby reducing the number of output lines. Further, a boosting capacitor is installed at the pixel. A voltage of a data signal is increased by the boosting capacitor to compensate for a charge sharing between a data capacitor and a storage capacitor. In other words, an aspect of the present invention increases the voltage of the data signal using the boosting capacitor that allows an image of a desired gradation to be exactly expressed.

Although a few embodiments of the present invention have been shown and described, it would be appreciated by those skilled in the art that changes might be made in this embodiment without departing from the principles and spirit of the invention, the scope of which is defined in the claims and their equivalents.

What is claimed is:

1. A pixel comprising:

an organic light emitting diode;

a storage capacitor coupled between a first power supply and an initialization power supply and being charged with a voltage corresponding to a data signal;

a first transistor controlling an amount of an electric current supplied to the organic light emitting diode corresponding to the voltage charged in the storage capacitor;

a second transistor coupled between a data line and a current scan line, supplying the data signal to a first electrode of the first transistor when a scan signal is supplied to the current scan line;

a third transistor coupled between a gate electrode and a second electrode of the first transistor, and being turned-on when the scan signal is supplied to the current scan line;

a fourth transistor coupled between the first power supply and the first electrode of the first transistor, and being turned-on or turned-off according to an emission control signal supplied to an emission control line;

a fifth transistor coupled between the second electrode of the first transistor and the organic light emitting diode, and being turned-on or turned-off according to the emission control signal supplied to the emission control line;

a sixth transistor coupled between the initialization power supply and the storage capacitor, and being turned-on when the scan signal is supplied to a previous scan line; and a boosting capacitor having a first electrode coupled between the current scan line and a gate electrode of the second transistor and a second electrode coupled to the gate electrode of the first transistor and between the storage capacitor and the sixth transistor, boosting a voltage of the gate electrode of the first transistor when a supply of the scan signal to the current scan line stops, wherein a capacitance of the boosting capacitor is set to be less than the capacitance of the storage capacitor.

2. An organic light emitting display comprising:

a data driver supplying data signals to respective output lines during a data period of a horizontal time period;

a scan driver sequentially supplying a scan signal to scan lines during a scan period of the horizontal time period which is a time period other than the data period, respectively, and supplying an emission control signal to emission control lines during at least two horizontal time periods;

demultiplexers installed at the respective output lines supplying the data signals to data lines during the data period;

data capacitors installed at the data lines storing the data signals; and pixels generating light of predetermined luminance corresponding to the data signals, wherein each of the pixels includes:

an organic light emitting diode;

a storage capacitor coupled between a first power supply and an initialization power supply and being charged with a voltage corresponding to one of the data signals;

a first transistor controlling an amount of an electric current supplied to the organic light emitting diode corresponding to the voltage charged in the storage capacitor;

a second transistor coupled between one of the data lines and one of the scan lines, supplying one of the data signals to a first electrode of the first transistor when the scan signal is supplied to the one of the scan lines;

a third transistor coupled between a gate electrode and a second electrode of the first transistor, and being turned-on when the scan signal is supplied to the one of the scan lines;

a fourth transistor coupled between the first power supply and the first electrode of the first transistor, and being turned-on or turned-off according to an emission control signal supplied to an emission control line from among the emission control lines;

a fifth transistor coupled between the second electrode of the first transistor and the organic light emitting diode, and being turned-on or turned-off according to the emission control signal supplied to the emission control line;

a sixth transistor coupled between the initialization power supply and the storage capacitor, and being turned-on when the scan signal is supplied to a previous scan line; and a boosting capacitor having a first electrode coupled between the current scan line and a gate electrode of the second transistor, and a second electrode coupled to the gate electrode of the first transistor and between the storage capacitor and the sixth transistor, boosting a voltage of the gate electrode of the first transistor when a supply of the scan signal to the current scan line stops, wherein a capacitance of the boosting capacitor is set to be less than the capacitance of the storage capacitor.

3. The organic light emitting display of claim 2, wherein a voltage of the initialization power supply is set to be less than a voltage of one of the data signals.

4. The organic light emitting display of claim 2, wherein one of the data capacitors is selected from a parasitic capacitor equivalently formed at one of the data lines and a separately constructed capacitor.

5. The organic light emitting display of claim 2, further comprising a demultiplexer controller sequentially outputting a plurality of control signals to the demultiplexers during the data period, respectively, so that the data signals to be supplied to one of the respective output lines are provided to one of the data lines.

6. The organic light emitting display of claim 5, wherein the demultiplexer controller sequentially provides the plurality of control signals so that the plurality of control signals do not overlap with each other during the data period.

7. The organic light emitting display of claim 5, wherein each of the demultiplexers includes at least one switching element coupled to a respective one of the output lines and a respective one of the data lines.

8. The organic light emitting display of claim 7, wherein the at least one switching element is turned-on to provide the data signals to the respective one of the data lines, when one of the control signals from the demultiplexer controller is supplied.

9. The organic light emitting display of claim 8, wherein when one of the control signals is supplied to the at least one switching element, the data signals provided to the respective one of the data lines are temporarily stored in a first data capacitor.

10. The organic light emitting display of claim 2, wherein the demultiplexers divide the data signals supplied by the respective output lines and output the divided data signals to the data lines.

* * * * *